US009737111B2

(12) United States Patent
Lustik

(10) Patent No.: US 9,737,111 B2
(45) Date of Patent: Aug. 22, 2017

(54) REMOVABLE SHOE INSERT FOR CORRECTIVE SIZING

(71) Applicant: Cara Lustik, New York, NY (US)

(72) Inventor: Cara Lustik, New York, NY (US)

( * ) Notice: Subject to any disclaimer, the term of this patent is extended or adjusted under 35 U.S.C. 154(b) by 150 days.

(21) Appl. No.: 13/842,992

(22) Filed: Mar. 15, 2013

(65) Prior Publication Data

US 2014/0259754 A1 Sep. 18, 2014

(51) Int. Cl.
*A43B 7/14* (2006.01)

(52) U.S. Cl.
CPC ..... *A43B 7/1425* (2013.01); *A43B 7/145* (2013.01); *A43B 7/1435* (2013.01); *A43B 7/1445* (2013.01)

(58) Field of Classification Search
CPC ..... A43B 7/1425; A43B 7/145; A43B 7/1465; A43B 7/1475; A43B 7/148; A43B 13/41; A43B 13/38
USPC ..... 36/43, 44
See application file for complete search history.

(56) References Cited

U.S. PATENT DOCUMENTS 2,569,721 A * 10/1951 Juers ..... 36/145
2,591,378 A 4/1952 Scholl
2,978,818 A 4/1961 Baumann
3,143,812 A * 8/1964 Bittner ..... A43B 13/38 36/155
3,344,537 A * 10/1967 Diamant ..... A43B 3/00 36/44
4,633,877 A * 1/1987 Pendergast ..... A43B 7/14 36/140
6,039,829 A * 3/2000 French ..... A41D 19/0068 156/251
6,176,025 B1 * 1/2001 Patterson et al. ..... 36/28
6,453,578 B1 * 9/2002 Yung et al. ..... 36/43
6,484,419 B1 * 11/2002 Rohde et al. ..... 36/10
2004/0194344 A1 * 10/2004 Tadin ..... 36/44
2005/0039349 A1 * 2/2005 Grisoni et al. ..... 36/71
2005/0060909 A1 * 3/2005 Kerns et al. ..... 36/28
2006/0185197 A1 * 8/2006 Rhenter ..... 36/174
2006/0277796 A1 * 12/2006 Gallegos ..... 36/44
2006/0277801 A1 * 12/2006 Schwarze ..... A43B 1/009 36/141
2007/0033834 A1 * 2/2007 Cheskin et al. ..... 36/44
(Continued)

FOREIGN PATENT DOCUMENTS

JP 2011254859 A 12/2011
RU 2181562 C2 4/2002
RU 2217026 C2 11/2003

OTHER PUBLICATIONS

International Search Report and Written Opinion for PCT/US2014/025863, dated Oct. 16, 2014, 6 pages.

*Primary Examiner* — Megan Brandon
(74) *Attorney, Agent, or Firm* — Klintworth & Rozenblat IP LLC

(57) ABSTRACT

A ball-of-foot type shoe insert has two regions with different compressibility characteristics, illustratively created by using polyurethane foam of difference densities, in a front region which, when the insert is positioned in a shoe, will underlie the toes of a wearer, and a rear region which, when positioned in a shoe, will underlie the ball of the foot. The front region is less compressible so that the toes in combination with the insert fill-up the toe box, thereby preventing the foot from sliding forward so that the anatomical heel of the wearer fits naturally in the heel of a shoe that is too big for the wearer.

6 Claims, 3 Drawing Sheets

(56) References Cited

U.S. PATENT DOCUMENTS

| | | | | |
|---|---|---|---|---|
| 2007/0074430 | A1* | 4/2007 | Coomer | 36/145 |
| 2008/0086909 | A1* | 4/2008 | Raspini | 36/44 |
| 2008/0086916 | A1* | 4/2008 | Ellis | 36/103 |
| 2009/0019730 | A1* | 1/2009 | Salminen et al. | 36/91 |
| 2009/0049712 | A1* | 2/2009 | Steszyn et al. | 36/91 |
| 2009/0188129 | A1* | 7/2009 | Fusco | A43B 7/142 36/44 |
| 2009/0193683 | A1* | 8/2009 | Igdari | 36/91 |
| 2010/0043252 | A1* | 2/2010 | Losio | 36/44 |
| 2010/0146816 | A1* | 6/2010 | Cappaert et al. | 36/91 |
| 2010/0251565 | A1* | 10/2010 | Litchfield | A43B 13/12 36/28 |
| 2010/0251568 | A1* | 10/2010 | Haruda | 36/43 |
| 2010/0281712 | A1* | 11/2010 | Campbell et al. | 36/28 |
| 2011/0041360 | A1* | 2/2011 | Torrance et al. | 36/91 |
| 2011/0072685 | A1* | 3/2011 | Gutowsky et al. | 36/44 |
| 2011/0099842 | A1* | 5/2011 | Burke et al. | 36/44 |
| 2011/0192049 | A1* | 8/2011 | Auger et al. | 36/44 |
| 2011/0219642 | A1* | 9/2011 | Sulak et al. | 36/44 |
| 2011/0232129 | A1* | 9/2011 | Roberts et al. | 36/88 |
| 2011/0302806 | A1* | 12/2011 | Auger et al. | 36/44 |
| 2012/0055041 | A1* | 3/2012 | Mackey et al. | 36/28 |
| 2012/0096745 | A1* | 4/2012 | Donato | 36/174 |

* cited by examiner

REMOVABLE SHOE INSERT FOR CORRECTIVE SIZING

BACKGROUND OF THE INVENTION

Field of the Invention

This invention relates generally to shoe inserts, and more particularly, to removable shoe inserts configured to fit in the toe box of a shoe, underlying the ball of the foot and under and in front of the toes, in order to prevent the foot from sliding forward in a pair of shoes that are too large for the foot of the wearer while maintaining the heel of the wearer in a natural position.

Description of the Related Art

There are a large variety of shoe inserts available on the market to increase the comfort of the wearer by proving cushioning, shock absorption, and the like. These inserts are typically made of a resilient material, such as cellular polymeric foams, illustratively polyurethanes, heat-sensitive viscoelastic memory foams, or gels and are generally configured to overlie the entire foot bed of the shoe. It is also known to provide shoe inserts that overlie the area of the foot bed that would be contacted by the ball of the foot and at least a portion of the toes. Ball of foot inserts are particularly useful in conjunction with high heeled shoes to prevent the foot from sliding forward and/or to provide cushioning against the increased forces on the ball of the foot that result from the elevation of the heel.

It is also known to use full sole and ball of foot-type inserts for making a shoe that is too big for the wearer fit better. Often women will purchase, or borrow, shoes that are perfect for an ensemble, but that are not available in their correct size. Children's shoes are frequently purchased in a larger size so that the child may grow into the shoe. In an effort to ameliorate the discomfort and/or aesthetic problems with wearing a shoe that is too large, it is known to use inserts. Inserts, which are typically of a uniform thickness, may help somewhat, but still leave the foot in an unnatural position in the shoe.

One suggestion for improving the fit is to use a full sole insert in conjunction with a ball of the foot insert either on top of the full sole insert, or on the vamp of the shoe, which is the portion of the shoe overlying the top of the forefoot so that the foot more fully occupies the toe box area to keep the foot from sliding forward. When the foot slides forward, the heel of the foot of the wearer is not in natural registration with the heel of the shoe. The resulting gap readily reveals that the shoe is too large for the wearer.

In view of the foregoing, it is evident that the prior art recognizes that use of an insert alone does not adequately address the problems encountered when wearing shoes that are too large.

While the primary goal of most shoe inserts is to improve comfort, U.S. Pat. No. 7,827,707 purports also to be useful in connection with making oversized shoes fit comfortably, particularly children's shoes. In this known arrangement, compressible viscoelastic polyurethane (memory foam), is cut to fit in the toe box of a shoe in the forward most portion that is unoccupied. The rear portion of the memory foam insert engages the front surface of at least some of the toes. When the shoe is worn with the known insert, the wearer's body temperature and the forces applied to the insert by the wearer cause the insert to conform to the tips of some of the wearer's toes. More specifically, the entire shoe insert of U.S. Pat. No. 7,827,707 sits in the toe box, and does not extend beneath the toes. Due to the resiliency of the memory foam, particularly in the case of high heeled shoes, the forward ends of the toes are forcefully urged forward against the insert. The resilience of the memory foam, coupled with the sliding of the ball of the foot forward on the incline of the shoe, as well as the inability of the tips of the toes to resist the applied forces for extended periods of time will permit the heel of the wearer to slide forward, away from registration with the heel portion of the shoe, resulting in the aforementioned gap that is not aesthetically pleasing and reveals that the shoe is too large for the wearer.

Of course, failure of the heel of the wearer to register naturally in the heel of the shoe can result in discomfort from chaffing as the heel slips in and out of the shoe during normal walking. In addition to blistering, this can also cause damage to hosiery. Moreover, the prolonged axial and lateral compression of the toes in the toe box, coupled with failure of the arch of the foot to register with the arch support of the shoe, will result in discomfort to the wearer.

Cushions that are configured to fit around the interior portion of the heel to prevent slippage are available commercially, but must be adhesively applied and permanently retained in each pair of shoe. It would be advantageous to have a shoe insert that is removable, comfortable, and yet retains the foot in position so as to prevent both sliding forward and heel slippage.

There is, therefore, a need for a shoe insert, particularly a removable and reusable shoe insert, that can be worn to cause oversize shoes to fit naturally and comfortably.

SUMMARY OF THE INVENTION

The foregoing and other objects are achieved by this invention which provides a ball-of-foot type insert having a compressible body that is configured to fit in the toe box of a shoe and to underlie the ball of the foot from the toes to the arch of the wearer. The compressible body is housed, or covered, with a stretchable knit fabric, illustratively acrylic or nylon. In advantageous embodiments, the shoe insert is washable and breathable.

The compressible body is divided into two regions, a front region which, when positioned in a shoe, will underlie the toes of a wearer, and a rear region which, when positioned, will underlie the ball of the foot. The two regions are defined by a stitch line, for example, which creates two chambers in the cover. The stitch line is placed so that the front region will be positioned forward of the metatarsal region at the base of the toes of the user. The chambers in the front region is filled with a material, such as polyurethane, that has a higher density than the material in the rear chamber, which may also be a polyurethane.

Since the front region has a higher density, it is less compressible. When in use, the foot of the wearer is prevented from sliding forward into the toe box because the front region of the shoe insert, in combination with the toes of the wearer, generally fill-up the toe box. Moreover, the forces driving the foot forward are counteracted at the metatarsal region where the compressibility of the two regions changes, rather than on the tips of the toes. The result is that the foot is held in a natural position in the oversize shoe so that the heel of the shoe is in alignment with the anatomical heel of the wearer.

BRIEF DESCRIPTION OF THE DRAWING

Comprehension of the invention is facilitated by reading the following detailed description, in conjunction with the annexed drawing, in which.

DETAILED DESCRIPTION

Figure 1:
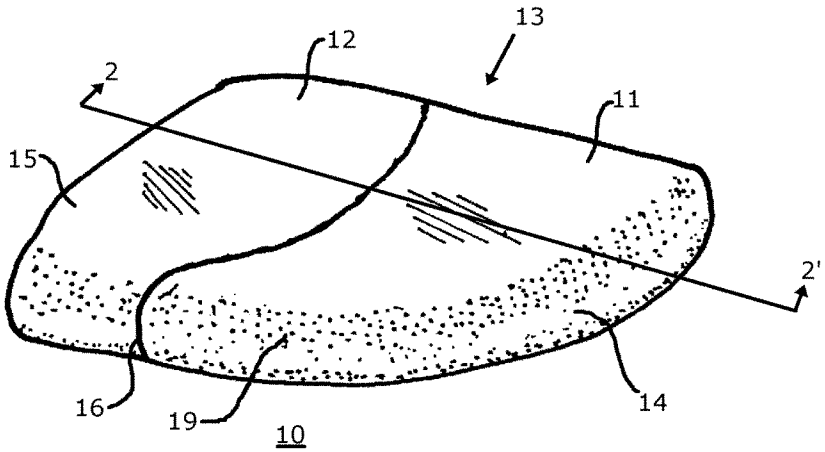
FIG. 1 is an isometric representation of a resilient compressible shoe insert constructed in accordance with the invention.

FIG. 1 is an isometric representation of a resilient compressible shoe insert 10 constructed in accordance with the invention. Shoe insert 10 is generically of the ball-of-foot type. That is, it is generally wedge-shaped and is configured to fit in the toe box of a shoe (not shown in this figure) underlying the area of the foot from the toes to the arch. The embodiment shown in FIG. 1 is configured to fit into a pointed toe box, but it is within the contemplation of the invention to configure the insert to fit other toe box shapes, such as round toe and square toe. There is shown in this figure a convex body 13 having two distinct regions 11 and 12.

Figure 2:
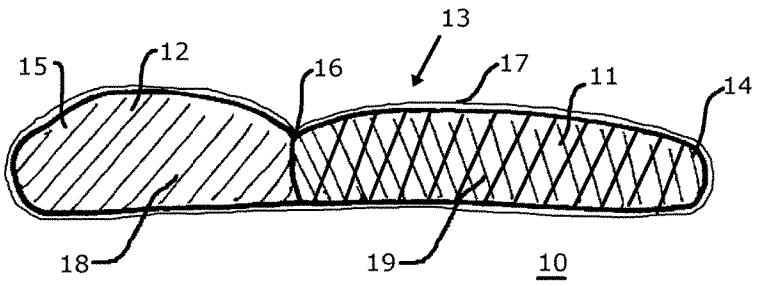
FIG. 2 is a longitudinal cross-section of shoe insert of FIG. 1.

FIG. 2 is cross-sectional representation of shoe insert 10 taken along longitudinal line 2-2' of FIG. 1, and extending along both regions 11 and 12 of convex body 13. Elements of structure that have previously been discussed are similarly designated. As used herein, region 11 has a front portion 14 which, when positioned in a shoe (not shown in this figure), will underlie the toes (not shown in this figure). Region 12 has a rear portion 15 that will underlie the ball of the foot (not shown in this figure). As will be discussed below in connection with FIG. 3, regions 11 and 12 advantageously have, in accordance with the invention, different compression characteristics.

In a specific illustrative embodiment, the shoe insert of the present invention is made from polyurethane foam. Polyurethane foam is readily available in a wide range of stiffness, hardness, and densities, and therefore, is an ideal material for use in the practice of the invention. However, it is to be understood that the insert can be fabricated from any other resilient and compressible material, such as other cellular polymer foams, that are known or developed in the art.

The difference in compression characteristics of regions 11 and 12 result from the use of polyurethane foam segments of different densities in the two regions. Referring once again to FIG. 2, the polyurethane foam segments are housed within a unified body, or cover 17, that in this embodiment is a knit material, such as acrylic or nylon. The cover material preferably is stretchable so as to conform well to the shape of the insert irrespective of whether the insert is deformed, as in use, or not. In this specific embodiment, the unified body is divided into two chambers by stitching at a stitch line 16. The chamber defining region 12 contains a lower density foam segment 18, which is more flexible and compressible than the foam segment in region 11. The chamber defining region 11 contains a higher density foam segment 19 that is less compressible. Stitch line 16 is placed so that the chambers are separated from one another so that, in use, the region of higher density 19 will be positioned forward of the metatarsal region at the base of the toes (not shown in this figure).

Figure 3:
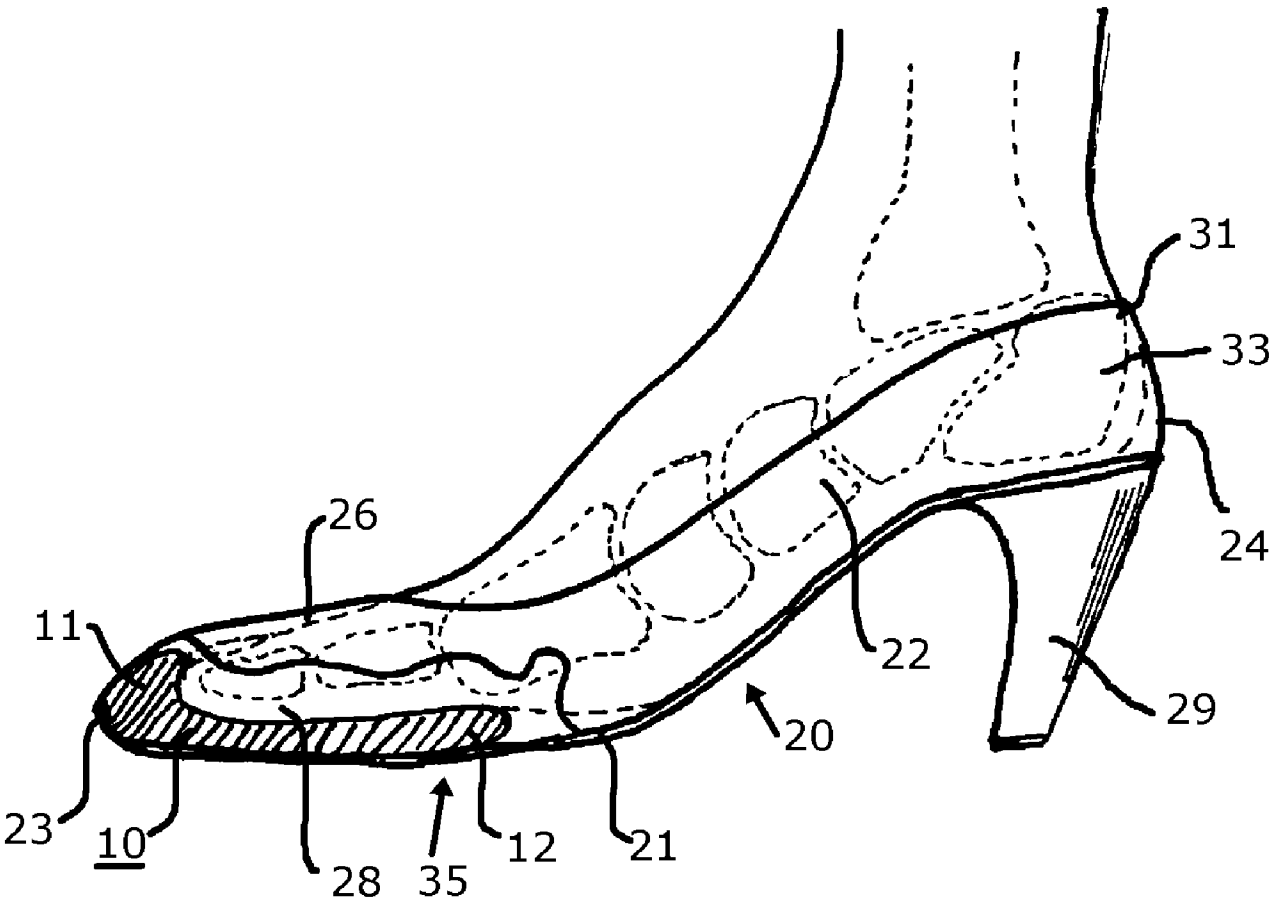
FIG. 3 is partially phantom and partially cross-sectional plan representation of a shoe insert in accordance with the present invention in use in a shoe with the foot of a wearer.

Referring to FIG. 3, it is seen that a shoe 20 includes a sole 21 and an upper 22. Sole 21 and upper 22 define the interior space of the shoe into which the foot inserted. The upper includes vamp 26 that overlies the top of the foot (above the toes). At the front 23 of the shoe, the sole and the vamp portion of the upper define the interior space of toe box 28. It is generally known that shoes are available with many toe box configurations, such as pointed, square, or rounded, and persons of skill in the art will readily understand that shoe insert 10 can be correspondingly configured. Rear portion 24 of shoe 20 includes, in this embodiment, a high heel 29 and a heel accommodation portion 31 that is configured to accommodate the back of the wearer's anatomical heel 33.

Figure 4:
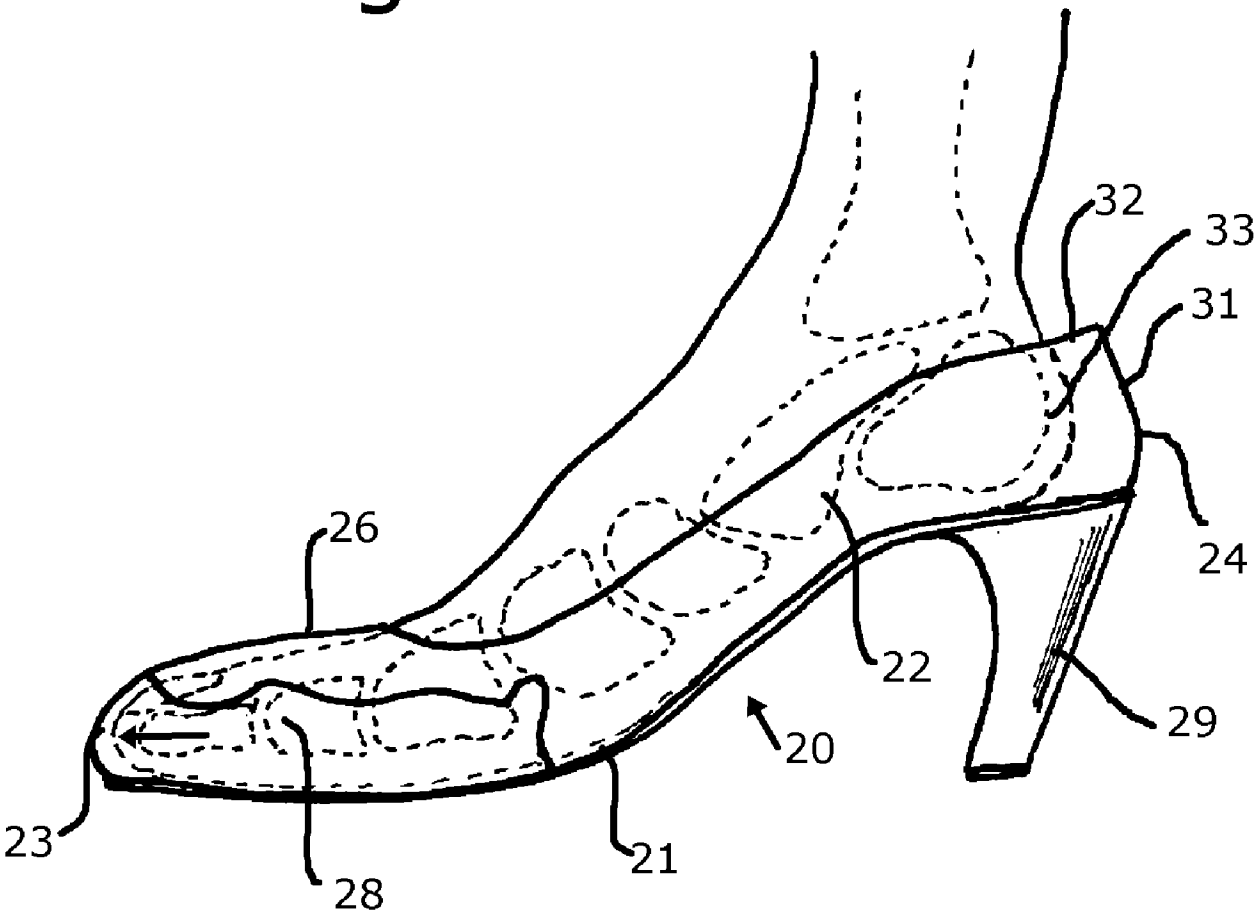
FIG. 4 is a partially phantom plan representation of a shoe with the foot of a wearer therein, but without the shoe insert of the present invention.

Although a high heeled shoe is shown is this embodiment, it is contemplated that the shoe insert of the present invention would be useful for any type of closed-toe shoe, such as boots, pumps, flats, wedges, platforms, oxfords, athletic shoes, etc. The shoe insert of the present invention is particularly advantageous, however, for high heeled shoes where the foot tends to slide forward due to the elevation of the heel. This problem is illustrated in FIG. 4 which shows high heeled shoe 20 being worn by a person, whose foot and ankle bones are shown in phantom. In this depiction, shoe 20 is too large for the size of the wearer's foot and a gap 32 is formed between heel 31 of the shoe and anatomical heel 33 of the wearer. FIG. 4 also shows that the toes of the wearer have advanced forward into toe box 28, as represented by the arrow (not specifically designated).

Referring once again to FIG. 3, insert 10 is shown in use in shoe 20. The insert underlies the ball of the foot (the metatarsal region) and the toes. Region 12, which underlies the ball (not specifically designated) of the foot, is flexible and compressible for comfort. The foot of the wearer is prevented from traveling forward into toe box 28 by insert 10, and specifically by denser region 11 which, in combination with the toes of the foot of the wearer, generally fills up the toe box. Advantageously, the force that is applied to keep the foot from sliding more deeply into the shoe is counteracted at the metatarsal region 35 rather than at the tips of the toes (not specifically designated). This is advantageous because the sliding weight of the wearer is supported by the rather robust metatarsal bones, in the region of the metatarsal-phalangeal joints, rather than the less robust phalanges. This results in greater comfort, and the foot is retained in a natural position so that heel 31 of the shoe is in natural alignment with anatomical heel 33 of the wearer. Thus, even though the shoe is too big for the wearer, there is no gap at the heel, such as that which is shown in FIG. 4, and the toes rest comfortably in the toe box.

Although the invention has been described in terms of specific embodiments and applications, persons skilled in the art can, in light of this teaching, generate additional embodiments without exceeding the scope or departing from the spirit of the claimed invention. For example, the shoe-contacting surface of the insert can be coated with an adhesive to secure the insert in place. In the alternative, the shoe-contacting surface can be fabricated from a fabric, or other material, having a higher degree of friction than the foot-contacting surface of the insert. Accordingly, it is to be understood that the drawing and description in this disclosure are proffered to facilitate comprehension of the invention, and should not be construed to limit the scope thereof.

What is claimed is:

1. A shoe insert comprising:

a cover including a seam forming a front compartment and a rear compartment, the cover forming a front terminal end of the shoe insert and a rear terminal end of the shoe insert;

a compressible first cellular polymer foam segment having a density and having top and bottom surfaces defined by a forward end, a rearward end and opposite side edges extending between the forward and rearward ends of the first cellular polymer foam segment, the first cellular polymer foam segment provided in the front compartment;

a compressible second cellular polymer foam segment having a density and having top and bottom surfaces defined by a forward end, a rearward end and opposite side edges extending between the forward and rearward ends of the second cellular polymer foam segment, the second cellular polymer foam segment provided in the rear compartment, the forward end of the second cellular polymer foam segment being adjacent to the rearward end of the first cellular polymer foam segment, the rearward end of the second cellular polymer foam segment is spaced from the rearward end of the first cellular polymer foam segment, the density of the second cellular polymer foam segment is lower than the density of the first cellular polymer foam segment;

wherein the first and second cellular polymer foam segments are compressed when engaged by a foot of a wearer, and wherein the first cellular polymer foam segment which, when positioned in a shoe, will underlie toes of the wearer and be positioned in front of the toes of the wearer to form a barrier between the toes of the wearer, and a toe box of the shoe, and the second cellular polymer foam segment which, when positioned in the shoe, will underlie a ball of the foot of the wearer, and wherein the rear terminal end does not extend past the ball of the foot of the wearer.

2. The shoe insert of claim 1, wherein the first cellular polymer foam segment is polyurethane and the second cellular polymer foam segment is polyurethane.

3. The shoe insert of claim 1, wherein the cover is formed of a knit material.

4. The shoe insert of claim 1, wherein the first and second cellular polymer foam segments are convex prior to engagement by the foot of the wearer, and the first and cellular polymer foam segments are compressed when engaged by the foot of the wearer.

5. The shoe insert of claim 4, wherein the cover covers the top and bottom surfaces of each of the first cellular polymer foam segment and the second cellular polymer foam segment.

6. The shoe insert of claim 1, wherein the cover covers the top and bottom surfaces of each of the first cellular polymer foam segment and the second cellular polymer foam segment.

* * * * *